US005925606A

United States Patent [19]

Stamm

[11] Patent Number: 5,925,606

[45] Date of Patent: Jul. 20, 1999

[54] CONCENTRATED ACIDIC LIQUID DETERGENT COMPOSITION

[75] Inventor: Charles L. Stamm, Kentwood, Mich.

[73] Assignee: Amway Corporation, Ada, Mich.

[21] Appl. No.: 08/742,385

[22] Filed: Nov. 1, 1996

[51] Int. Cl.[6] ..... C11D 1/75; C11D 1/72; C11D 1/12; C11D 7/08

[52] U.S. Cl. ..... 510/238; 510/191; 510/199; 510/237; 510/245; 510/253; 510/255; 510/362; 510/363; 510/398; 510/413; 510/414; 510/421; 510/426; 510/432; 510/433; 510/477; 510/488; 510/503

[58] Field of Search ..... 510/191, 199, 510/238, 237, 245, 253, 255, 362, 363, 398, 413, 414, 421, 426, 432, 433, 477, 488, 503

[56] References Cited

U.S. PATENT DOCUMENTS

| | | | |
|---|---|---|---|
| H1478 | 9/1995 | Prieto . | |
| 3,943,234 | 3/1976 | Roggenkamp . | |
| 3,954,646 | 5/1976 | Dewar et al. | 252/106 |
| 4,018,699 | 4/1977 | Lindy . | |
| 4,052,342 | 10/1977 | Fernley et al. . | |
| 4,098,713 | 7/1978 | Jones . | |
| 4,133,779 | 1/1979 | Hellyer et al. . | |
| 4,181,623 | 1/1980 | Dillarstone et al. . | |
| 4,206,070 | 6/1980 | Jones . | |
| 4,207,421 | 6/1980 | Scardera et al. . | |
| 4,223,163 | 9/1980 | Guilloty . | |
| 4,239,552 | 12/1980 | Perner et al. . | |
| 4,276,205 | 6/1981 | Ferry . | |
| 4,302,349 | 11/1981 | Kosswig et al. . | |
| 4,303,544 | 12/1981 | Kosswig et al. . | |
| 4,392,977 | 7/1983 | Altenschöpfer et al. . | |
| 4,465,612 | 8/1984 | Altenschöpfer et al. . | |
| 4,474,678 | 10/1984 | Lutz et al. . | |
| 4,492,646 | 1/1985 | Welch . | |
| 4,501,680 | 2/1985 | Aszman et al. | 252/142 |
| 4,522,740 | 6/1985 | Schmid et al. . | |
| 4,690,779 | 9/1987 | Baker et al. . | |
| 4,714,610 | 12/1987 | Gerstein | 424/70 |
| 4,776,974 | 10/1988 | Stanton et al. . | |
| 4,808,235 | 2/1989 | Woodson et al . | |
| 4,861,516 | 8/1989 | Kurzendoerfer et al. . | |
| 4,863,629 | 9/1989 | Osberghaus et al. . | |
| 4,876,035 | 10/1989 | Breitzke et al. . | |
| 4,909,962 | 3/1990 | Clark . | |
| 4,929,380 | 5/1990 | Schulz et al. . | |
| 5,008,030 | 4/1991 | Cook et al. | 252/106 |
| 5,057,246 | 10/1991 | Bertho et al. . | |
| 5,061,393 | 10/1991 | Linares et al. | 252/143 |
| 5,080,831 | 1/1992 | Vaneenam . | |
| 5,096,621 | 3/1992 | Tosaka et al. . | |
| 5,120,469 | 6/1992 | Smith et al. . | |
| 5,160,658 | 11/1992 | Smith et al. . | |
| 5,164,117 | 11/1992 | Sauer et al. . | |
| 5,232,632 | 8/1993 | Woo et al. | 252/546 |
| 5,238,609 | 8/1993 | Smith et al. . | |
| 5,264,147 | 11/1993 | Houghton et al. . | |
| 5,279,756 | 1/1994 | Savio et al. . | |
| 5,298,195 | 3/1994 | Brumbaugh . | |
| 5,362,422 | 11/1994 | Masters | 252/544 |
| 5,364,551 | 11/1994 | Lentsch et al. | 252/156 |
| 5,384,063 | 1/1995 | Woo et al. | 252/142 |
| 5,443,757 | 8/1995 | Brumbaugh . | |

*Primary Examiner*—Paul Lieberman
*Assistant Examiner*—Charles Boyer
*Attorney, Agent, or Firm*—Brinks Hofer Gilson & Lione

[57] ABSTRACT

A liquid cleaning composition includes a carboxylic acid, surfactant and organic solvent. The composition is particularly effective for removing soap scum, limescale and hard water spots from tubs, tiles and showers.

1 Claim, No Drawings

CONCENTRATED ACIDIC LIQUID DETERGENT COMPOSITION

BACKGROUND OF THE INVENTION

The present invention relates to a liquid cleaning composition for use on hard surfaces such as tubs, tiles and showers. The composition is especially effective against soap scum, lime scale and hard water spots.

Typically, acid cleaners contain inorganic or mineral acids such as hydrochloric acid, sulfuric acid, nitric acid, phosphoric acid and the like. Cleaners of this type are corrosive. Generally, the more efficacious the cleaners, the more corrosive. The corrosiveness of the cleaners is also an issue with regard to transportation laws and the transporting of such products. Additionally, acidic cleaners of this type are very irritating to the skin of the user. Thus, there is a continual search for efficacious cleaners that are not irritating or corrosive.

SUMMARY OF THE INVENTION

It has now been found that certain organic acids are as effective as inorganic acids against soap scum, hard water spots, lime scale and the like. Organic acids are milder, less corrosive and less irritating to the skin of the user. Thus, in accordance with the present invention, there is provided a stable, concentrated cleaner containing carboxylic acid that removes soap scum, lime scale, hard water spots and the like without being corrosive or irritating.

The liquid tub and tile cleaner of the present invention comprises carboxylic acid, surfactant and organic solvent. In one embodiment, the tub and tile cleaner of the present invention is a liquid cleaning composition comprising from about 0.25% to about 50% by weight of an acid selected from the group consisting of carboxylic acids having up to about 6 carbon atoms, from about 0.50% to about 50% by weight of a surfactant selected from the group consisting of nonionic and anionic surfactants and mixtures thereof and from about 0.25% to about 20% by weight organic solvent.

In a preferred embodiment, the present invention is a liquid tub and tile cleaner consisting essentially of the following: from about 0.5% to about 15% by weight hydroxyacetic acid; from about 0.25% to about 10% by weight $C_{11}$ alcohol ethoxylated with an average of 7 moles of ethylene oxide; from about 0.05% to about 2% by weight cocamidopropyl amine oxide; from about 0.05% to about 1.25% by weight sodium lauryl sulfate; from about 0.25% to about 10% by weight propylene glycol monomethyl ether; and from about 0.1% to about 5% by weight triethanolamine, wherein the balance is water.

The liquid cleaner is a clear solution which remains so during storage over an extended period of time. The viscosity of the cleaner is about 5 to about 15 centipoise.

These and other objects, advantages and features of the present invention will be better understood upon review of the following detailed description of the presently preferred embodiments. It is noted that, unless otherwise stated, all percentages given in this specification and the appended claims refer to percentages by weight of the total composition.

DETAILED DESCRIPTION OF THE PREFERRED EMBODIMENTS

The present invention relates to a liquid cleaning composition containing carboxylic acid which is especially suited for removing soap scum, lime scale, hard water spots and the like from tubs, tiles and showers. Generally, the cleaning composition includes carboxylic acid, surfactant and organic solvent.

Carboxylic Acid

The acid useful in the cleaner of the present invention is selected from the group consisting of carboxylic acids having up to 6 carbon atoms such as, for example, formic, acetic, butyric and caproic acids and derivatives thereof. Preferably, the carboxylic acid is a hydroxy monocarboxylic acid having up to 4 carbon atoms. Hydroxyacetic acid is the preferred acid. The carboxylic acid will generally be present in an amount ranging from about 0.25% to about 50%, preferably from about 1% to about 25% and more preferably from about 4% to about 12%.

Surfactant

The surfactant used in the present invention is selected from the group consisting of anionic and nonionic surfactants and mixtures thereof. Nonionic surfactants are well known in the detergency art. Nonlimiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with an average of 9.5 moles of ethylene oxide per mole of nonyl phenol; dodecylphenol condensed with an average of 12 moles of ethylene oxide per mole of phenol; dinonyl phenol condensed with an average of 15 moles of ethylene oxide per mole of phenol and diisooctyl phenol condensed with an average of 15 moles of ethylene oxide per mole of phenol.

(2) The condensation products of aliphatic alchols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with an average of 10 moles of ethylene oxide per mole of alcohol; the condensation product of an average of 9 moles of ethylene oxide with coconut alcohol (a mixture of fatty alcohols with alkyl chains varying in length from about 10 to 14 carbon atoms); and the condensation product of undecanol with an average of 7 moles of ethylene oxide.

(3) The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide.

(4) The condensation of ethylene oxide with the product resulting from the reaction of propylene oxide and ethylenediamine. The hydrophobic moiety of these products consists of the reaction product of ethylenediamine and excess propylene oxide, the moiety having a molecular weight of from about 2500 to about 3000. This hydrophobic moiety is condensed with propylene oxide to the extent that the condensation product contains from about 40% to about 80% by weight of polyoxyethylene and has a molecular weight of from about 5,000 to about 11,000.

(5) Amido amine oxides comprising compounds and mixtures of compounds having the formula:

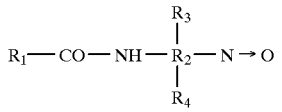

wherein $R_1$ is a $C_8$–$C_{18}$ alkyl, $R_2$ is a $C_2$–$C_4$ alkyl and $R_3$ and $R_4$ are a $C_1$–$C_5$ alkyl or hydroxyalkyl. Examples of amido amine oxides which may be useful in the present invention include, but are not limited to, babassuamidopropyl amine oxide, cocamidopropyl amine oxide, isostearylamidopropyl amine oxide, isostearylamidopropyl morpholine oxide, lauramidopropyl amine oxide, minkamidopropyl amine oxide, oleoamidopropyl amine oxide, olivamidopropyl amine oxide, sesamidopropyl amine oxide, stearamidopropyl amine oxide and wheat germ amidopropyl amine oxide.

Preferably, the nonionic surfactant is selected from the group consisting of amido amine oxides, the condensation products of aliphatic alcohols with about 1 to about 25 moles of ethylene oxide and mixtures thereof Even more preferable is a mixture of a $C_8$–$C_{14}$ alcohol ethoxylated with 5–12 moles of ethylene oxide and an amido amine oxide of the formula:

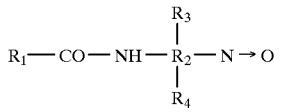

wherein $R_1$ $^{a\ c}{}_{10}$–$C_{14}$ alkyl, $R_2$ is ethyl or propyl and $R_3$ and $R_4$ are methyl or ethyl. According to the most preferred embodiment, the nonionic surfactant is a mixture of cocamidopropyl amine oxide and an 11-carbon alcohol ethoxylated with an average of 7 moles of ethylene oxide.

The nonionic surfactant will generally be present at a level of about 0.05% to about 20% by weight, preferably in the range of about 0.10% to about 15%, and more preferably in the range of about 0.50% to about 11.50%. When a mixture of cocamidopropyl amine oxide and an 11-carbon alcohol ethoxylated with an average of 7 moles of ethylene oxide is used according to the preferred embodiment, the ethoxylated alcohol is present in an amount ranging from about 0.25% to about 12%, preferably from about 0.40% to about 10%, and the cocamidopropyl amine oxide is present in amount ranging from about 0.05% to about 3%, preferably from about 0.10% to 2%.

The surfactant useful in the liquid cleaning composition of the present invention may also be an anionic surfactant. Most anionic surfactants can be broadly described as the water-soluble salts, particularly the alkali metal, alkaline earth metal, ammonium and amine salts, of organic sulfuric reaction products having in their molecular structure an alkyl radical containing from about 8 to about 22 carbon atoms and a sulfonic acid radical. In particular, the anionic surfactants useful in the present invention are the sulfonates, alkyl sulfates and alkyl ether sulfates having an alkyl chain length of from about 8 to about 18 carbon atoms. The alkyl sulfates are the preferred anionic surfactant. In accordance with the most preferred embodiment, the anionic surfactant is sodium lauryl sulfate.

The anionic surfactant generally will be present in the liquid cleaning composition at a level of about 0.01% to about 1.25%. Preferably, the amount of anionic surfactant present in the liquid cleaning composition ranges from about 0.06% to about 1.13%. Generally, the ratio of nonionic surfactant to anionic surfactant should be in the range of about 1 :1 to about 15: 1. Preferably, the ratio of nonionic surfactant to anionic surfactant is about 10:1.

Solvent

Organic solvents such as $C_1$–$C_6$ alkyl ethers of ethylene and propylene glycol and derivatives thereof, $C_1$–$C_4$ alcohols and lower ketones containing 2 to 4 carbon atoms are used to improve the solubility of the surfactant in the composition. The organic solvents also improve detergency by dissolving bath oils and soap scum. A preferred solvent for this purpose is methoxypropanol (propylene glycol monomethyl ether). The organic solvent is present in an amount in the range of from about 0.25% to about 20%, preferably from about 0.40% to about 10%.

Additives

Other ingredients such as pH adjusters, stabilizing agents, preservatives, fragrances and dyes may also be included in the liquid cleaning composition of the present invention, so long as they do not detract from the advantages resulting from the compositions of the present invention. Stabilizing agents may be included to achieve phase stability, pH balance and other desired characteristics. Commonly used hydrotropes can include mono, di and triethanolamine.

The pH of the liquid cleaner is in the range of about 2–4. A composition with a pH below about 2 is too corrosive due to the acidic nature of the composition. A composition with a pH above about 4 is not effective in removing lime scale. Agents for controlling the pH include carbonates and bicarbonates, mono, di and triethanolamine and alkali metal hydroxides. The mono, di and triethanolamines are preferred. Most preferred as both a stabilizing agent and a pH controlling agent is triethanolamine, which is present in an amount between about 0.10% and about 4.5%, preferably from about 0.20% to about 4%.

Fragrance can also be added in an amount up to about 1%.

Water

Water comprises the balance of the liquid cleaning composition. Accordingly, the liquid cleaning composition of the present invention contains from about 60% to about 99% water.

The following examples are given to illustrate the cleaning compositions of the present invention. In the examples, the abbreviations used have the following meanings.

| Abbreviation | Description |
|---|---|
| Acid | Hydroxyacetic acid |
| SLS | Sodium lauryl sulfate |
| Glycol ether | Propylene glycol monomethyl ether |
| COA | Cocamidopropyl amine oxide |
| TEA | Triethanolamine |
| $C_{11-7}$ | $C_{11}$ alcohol ethoxylated with an average of 7 moles of ethylene oxide |
| $C_{25-9}$ | $C_{12-15}$ alcohol ethoxylated with an average of 9 moles of ethylene oxide |

In preparing the following compositions, the ingredients may be added in any order.

| | A | B | C | D |
|---|---|---|---|---|
| SLS | 0.90 | 1.13 | 0.06 | 0.90 |
| Acid | 8.25 | 11.90 | 0.63 | 8.25 |
| Glycol ether | 7.50 | 9.38 | 0.49 | 7.50 |
| COA | 1.57 | 1.96 | 0.10 | 1.57 |
| TEA | 3.00 | 3.75 | 0.20 | 3.00 |
| $C_{11-7}$ | — | 9.38 | 0.49 | — |
| $C_{25-9}$ | 7.50 | — | — | 3.75 |
| Additional ingredients | — | 0.20 | 0.01 | — |
| Water | | Remainder | | |

By way of example, the most preferred embodiment of the present invention is a liquid cleaning composition consisting essentially of the following ingredients:

| Component | Amount (wt. %) |
|---|---|
| Sodium lauryl sulfate | 0.90 |
| $C_{11}$ alcohol ethoxylated with an average of 7 moles of ethylene oxide | 7.50 |
| Hydroxyacetic acid | 9.52 |
| Triethanolamine | 3.00 |
| Propylene glycol monomethyl ether | 7.50 |
| Cocamidopropyl amine oxide | 1.57 |
| Water | 69.81 |
| Fragrance | 0.20 |

The cleaning composition of the present invention is used by spraying the composition onto the surface of the tub, tiles or shower to be cleaned. Preferably, the composition is bottled in a spray system assembly as a superconcentrate such as that shown and described in U.S. Pat. No. 5,152,461 to Proctor. The superconcentrate is diluted for a particular use according to the level of soiling. An adjustable wheel on the spray nozzle of the spray system automatically controls the dilution of the superconcentrate when mixed with water in the pump of the spray system. The liquid cleaner of the present invention is advantageous in that it may be used at variable strengths according to the level of soiling. In this way, only one cleaning product is needed to remove varying levels of soap scum, lime scale, hard water spots and the like.

Of course, it should be understood that a wide range of changes and modifications can be made to the embodiments described above. It is intended, therefore, that the foregoing description illustrates rather than limits this invention, and that it is the following claims, including all equivalents, that define this invention.

What is claimed is:

1. A liquid cleaning composition consisting essentially of:

a. from about 0.5% to about 15% hydroxyacetic acid;

b. from about 0.05% to about 20% $C_{11}$ alcohol ethoxylated with about 7 moles of ethylene oxide;

c. from about 0.05% to about 3% cocamidopropyl amine oxide;

d. from about 0.01% to about 1.25% sodium lauryl sulfate;

e. from about 0.25% to about 20% propylene glycol monomethyl ether; and f. from about 0.1% to about 4.5% triethanolamine.

* * * * *